US008100276B2

(12) United States Patent
Moor

(10) Patent No.: US 8,100,276 B2
(45) Date of Patent: Jan. 24, 2012

(54) COLLAPSIBLE FLUID CONTAINERS

(75) Inventor: Timothy Nicholas Moor, Stillington York (GB)

(73) Assignee: EV (Baby Limited) (GB)

( * ) Notice: Subject to any disclaimer, the term of this patent is extended or adjusted under 35 U.S.C. 154(b) by 611 days.

(21) Appl. No.: 11/596,415

(22) PCT Filed: May 10, 2005

(86) PCT No.: PCT/EP2005/005136

§ 371 (c)(1),
(2), (4) Date: Nov. 19, 2007

(87) PCT Pub. No.: WO2005/107680

PCT Pub. Date: Nov. 17, 2005

(65) Prior Publication Data

US 2008/0061023 A1 Mar. 13, 2008

(30) Foreign Application Priority Data

May 11, 2004 (GB) ..... 0410460.0
Sep. 15, 2004 (GB) ..... 0420490.5

(51) Int. Cl.
*A61J 9/06* (2006.01)
*A61J 9/08* (2006.01)

(52) U.S. Cl. ..... 215/11.3; 215/11.1; 215/11.6; 220/9.1; 220/737; 220/740; 426/117

(58) Field of Classification Search ..... 215/11.1, 215/11.5, 11.6, 354, 11.3; 383/44; 426/115, 426/117; 220/9.1, 9.4, 737, 740
See application file for complete search history.

(56) References Cited

U.S. PATENT DOCUMENTS

| | | | | | |
|---|---|---|---|---|---|
| 2,876,113 | A | * | 3/1959 | Barton | 426/117 |
| 3,272,202 | A | * | 9/1966 | Hurtado Soto | 215/11.6 |
| 3,718,140 | A | | 2/1973 | Yamauchi | 128/252 |
| 3,746,198 | A | * | 7/1973 | Howland | 215/11.1 |
| 4,193,506 | A | * | 3/1980 | Trindle et al. | 215/11.6 |
| 4,282,863 | A | * | 8/1981 | Beigler et al. | 604/262 |
| 4,678,092 | A | * | 7/1987 | Rane | 215/11.3 |
| 4,815,615 | A | * | 3/1989 | Phlaphongphanich | 215/11.1 |
| 5,257,865 | A | * | 11/1993 | Tani | 383/78 |
| 5,307,955 | A | * | 5/1994 | Viegas | 222/107 |
| 5,429,254 | A | * | 7/1995 | Christine | 215/11.1 |
| 6,000,848 | A | * | 12/1999 | Massioui | 383/80 |
| 6,551,639 | B1 | * | 4/2003 | Nye et al. | 426/117 |
| 6,669,013 | B1 | * | 12/2003 | Villanueva | 206/219 |
| 6,685,691 | B1 | * | 2/2004 | Freund et al. | 604/403 |

FOREIGN PATENT DOCUMENTS

| | | | |
|---|---|---|---|
| DE | 202 02 205 | | 8/2002 |
| FR | 2655315 | | 6/1991 |
| FR | 2664812 | | 1/1992 |
| GB | 1337550 | | 11/1973 |
| GB | 2181062 | A * | 4/1987 |

OTHER PUBLICATIONS

International Search Report dated Oct. 4, 2005 from PCT/EP2005/005136.

* cited by examiner

*Primary Examiner* — Sue Weaver
(74) *Attorney, Agent, or Firm* — Ohlandt, Greeley, Ruggiero & Perle, LLP

(57) ABSTRACT

A collapsible container for fluids consists of a flexible bag or pouch hermetically attached to a cover. The container may be provided flat packed, pre-sterilised and hermetically packaged and may be a single use, disposable, container useful for drinking bottles for young children and babies.

36 Claims, 8 Drawing Sheets

Figure 1 A i
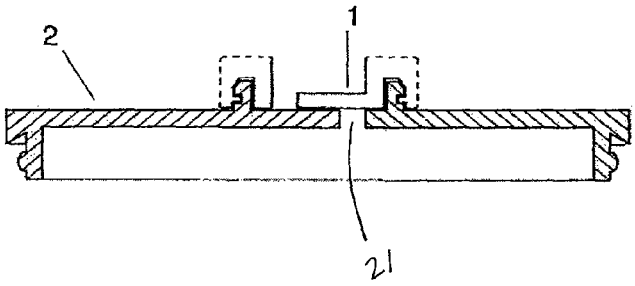
Figure 1 A ii
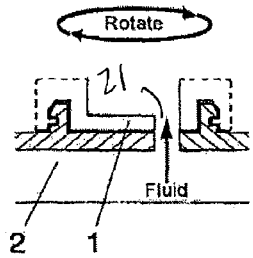
Figure 1 B i
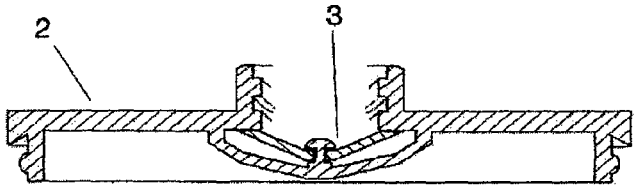
Figure 1 B ii
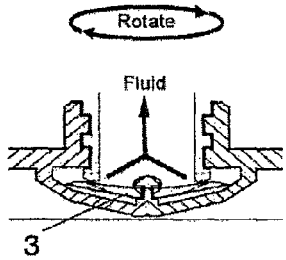
Figure 1 B iii
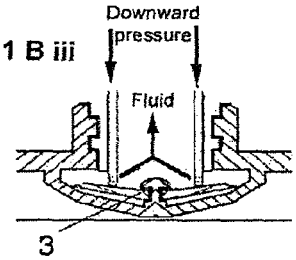
Figure 1 C i
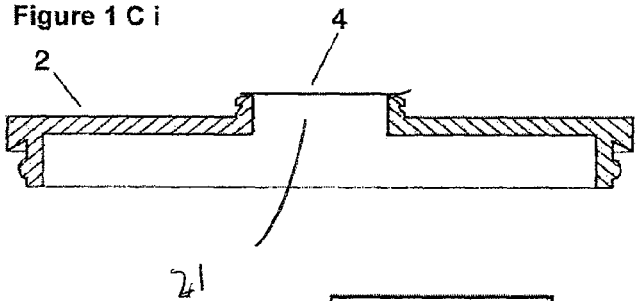
Figure 1 C ii
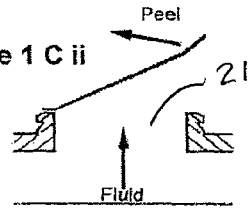
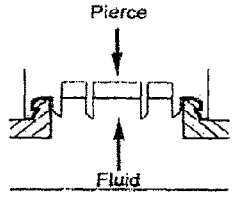
Figure 1 C iii
Figure 1 C iv
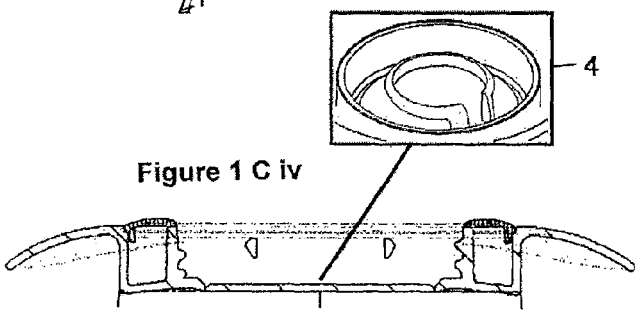

Figure 1 D i
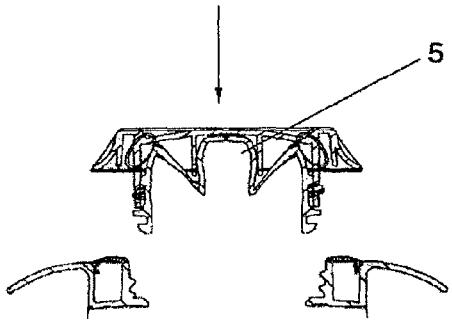
Figure 1 D ii
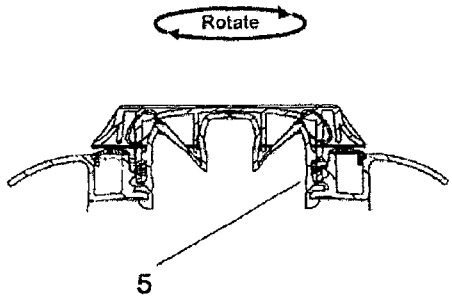
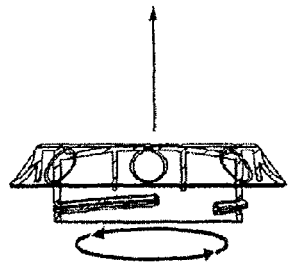
Figure 1 D iii
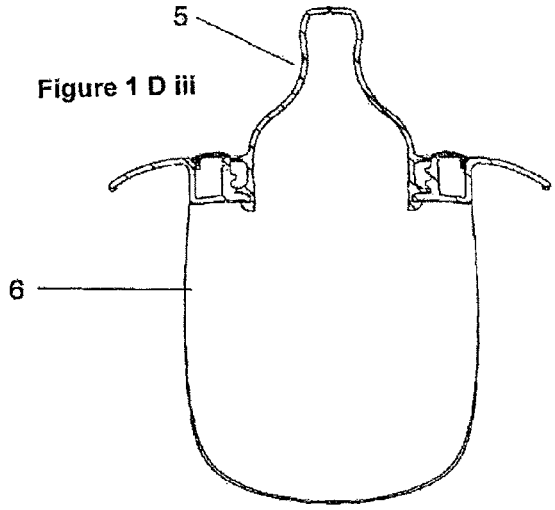

Figure 2A
Figure 2B
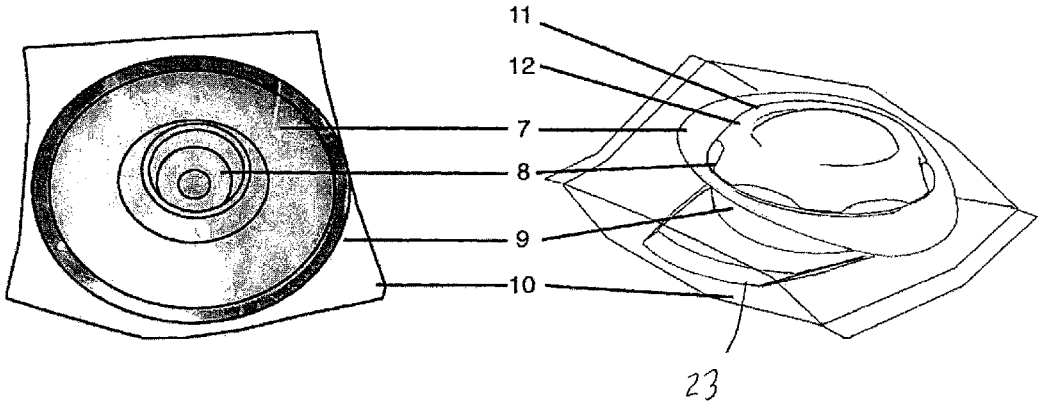
Figure 3A
Figure 3B
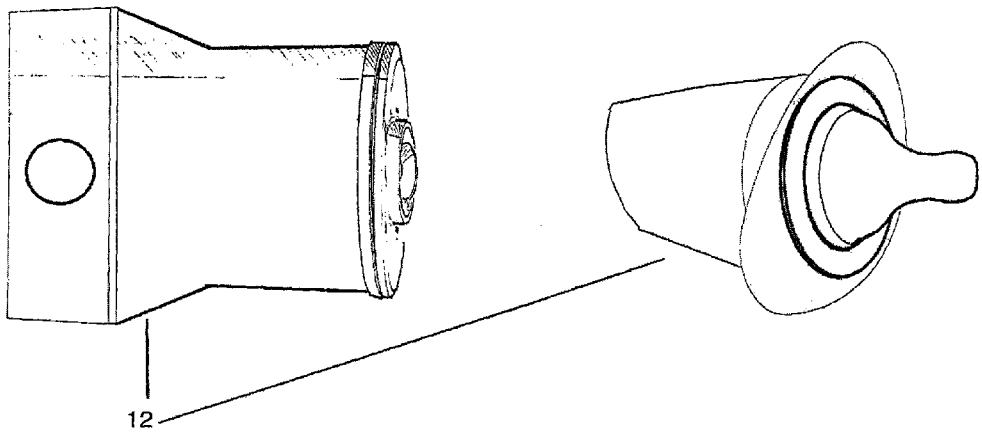

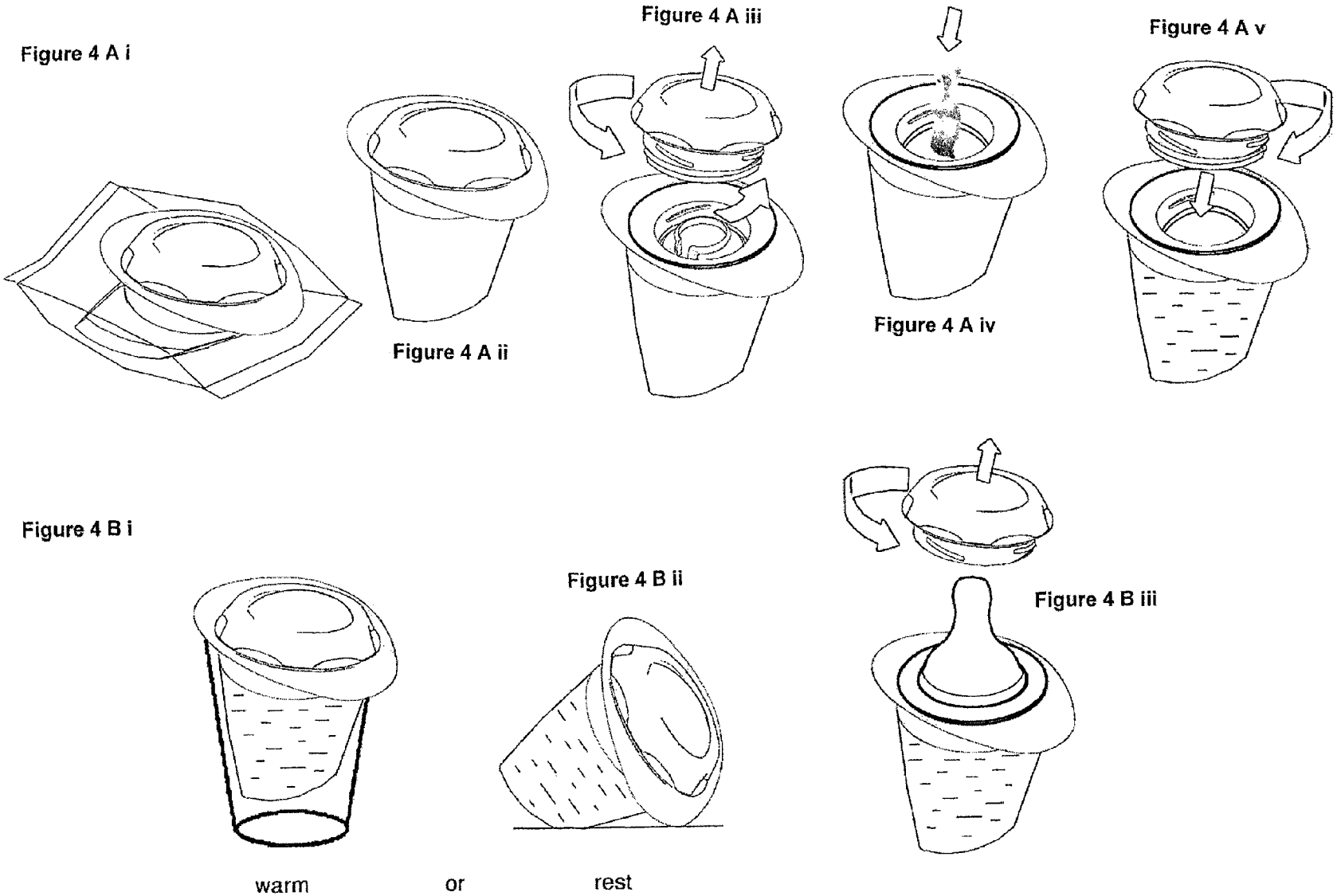
Figure 4 A i
Figure 4 A ii
Figure 4 A iii
Figure 4 A iv
Figure 4 A v
Figure 4 B i
warm
or
rest
Figure 4 B ii
Figure 4 B iii Figure 6 A
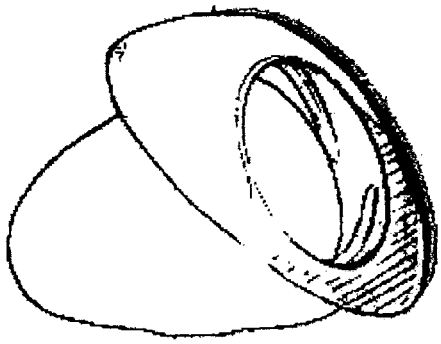
Figure 6 B
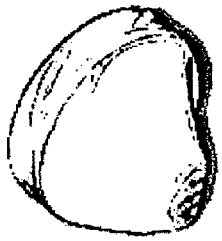
Figure 6 C
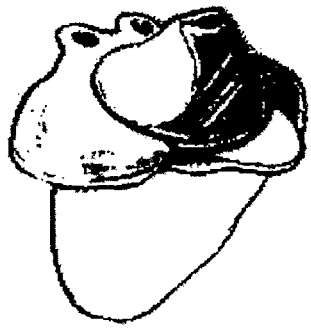
Figure 7 A
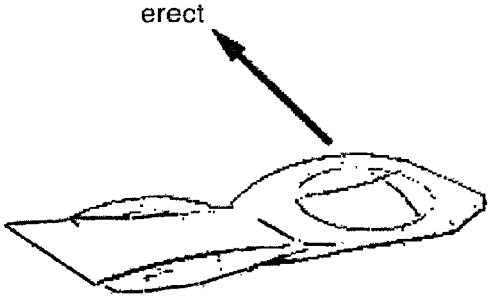
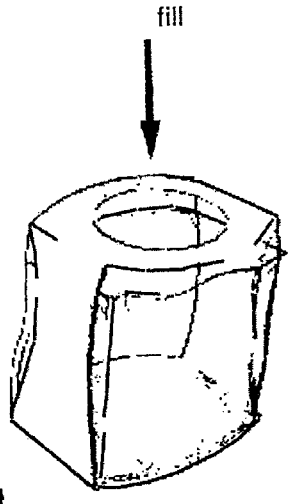
Figure 7 B
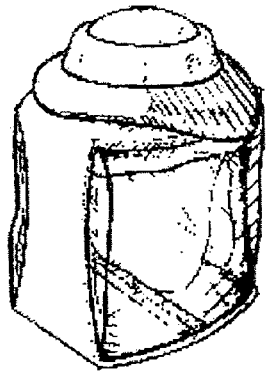
Figure 7 C

COLLAPSIBLE FLUID CONTAINERS

BACKGROUND

1. Field

The present disclosure relates to fluid receptacles which may be used to retain fluids particularly drinks containers and especially drinks containers that are disposable. The invention is particularly concerned with bottles for babies and small children and more particularly with disposable baby bottles.

2. Discussion of the Background Art

Drinking vessels for babies and young children are typically rigid vessels provided with a removable lid to enable the vessel to be filled and cleaned and often provided with a teat to enable drinking. These vessels tend to be for multi use and may require sterilisation before each use. The vessels also take up considerable space when empty and not in use. Furthermore they cannot be sterilised easily in an environment out of the home. Collapsible containers are known such as for example from Gebrauchsmusterschrift DE 20202205 A1. However this container requires a separate stand during use, a separate clip for attachment of a handle and has no valve or seal for retaining the contents once filled. Furthermore this container is not totally disposable or recyclable in its complete form.

The present disclosure provides a fluid container which can be flat packed when empty, can be provided pre-sterilised, can be readily filled and which is disposable after use. In particular the present disclosure provides a baby bottle having these desirable properties.

SUMMARY

In one embodiment the present disclosure therefore provides a flat packed evacuated and/or folded container comprising a flexible bag or pouch hermetically attached to a sealed cover and further provided on the cover with an opening to enable filling of the container sealed by a non-return valve.

BRIEF DESCRIPTION OF THE DRAWINGS

FIGS. 1Ai, 1Aii, 1Bi, 1Bii and 1Biii are cross-sectional views of various types of non-return valves according to one embodiment of the present disclosure;

FIGS. 1Ci-1Civ depict a cross-sectional view of a typical seal in the form of a ring pull which is useful according to another embodiment of the present disclosure;

FIGS. 1Di-1Diii depict a cross-sectional view of a typical mouthpiece and lid configuration and interaction according to the present disclosure;

FIGS. 2A and B depicts a flat packed packaged container according to the present disclosure;

FIGS. 3A and B show the container of FIGS. 2A and B in inflated form containing a liquid;

FIGS. 4Ai-4Av and 4Bi-4Biii depict the container of FIGS. 2A and B in use;

FIGS. 6A-C illustrates how the container may be shaped for toddlers;

FIGS. 7A-C illustrates a flat packed resurrectable baby bottle stand according to the present disclosure;

DETAILED DESCRIPTION OF THE PREFERRED EMBODIMENT

Figure 5A:
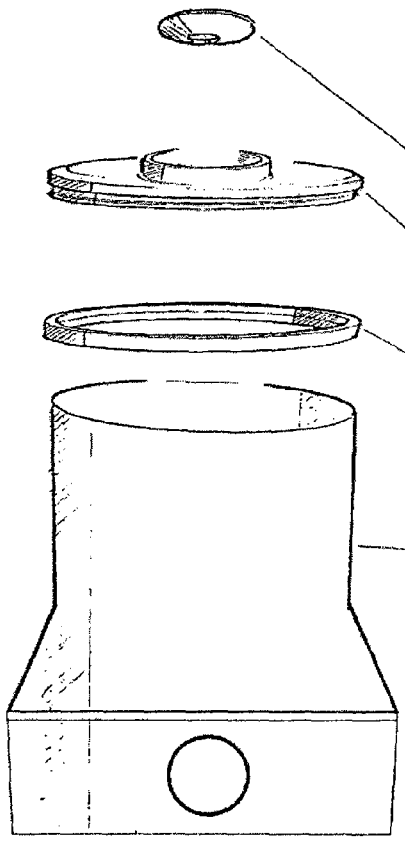
FIGS. 5A and B are exploded views showing the components of the container and their method of assembly.

In a preferred embodiment the container is provided with a variable cover sealing system comprising a ring pull or thin film seal, such as is illustrated in FIGS. 1Ci-iv, and/or a fluid delivery tube through which material can be expelled from the container such as through the drinking of the contents and a plug and/or a cap/lid, as is illustrated in FIGS. 1Di-iii, 8, 9A, 9B, 10A and 10B.

In another embodiment the container is sterilised prior to flat packing and in a yet further embodiment the container, preferably sterilised, may be enclosed in a hermetically sealed bag or envelope to reduce the risk of contamination prior to use. The bag or envelope may conveniently be made of material that provides protection for the container and any contents against ultra violet radiation.

A preferred container of the present disclosure consists of a flexible bag or pouch and a separate cover lid and a band or clip which enables the bag or pouch to be hermetically attached to the rim of the lid. The rim of the lid may be provided with a groove into which the band will fit and hold the mouth of the bag or pouch as a tight fit in the rim of the lid. In this way the bag or pouch and the lid may be made of different materials according to the function they are required to perform. In addition, or alternatively the bag or pouch may have been sealed to the rim of the lid by welding without the requirement of the band or clip. Where the bag is sealed to the lid it is preferred that it be sealed to a horizontal surface provided by the base of the lid, in this embodiment the bag or pouch may be readily sealed to the lid by ultrasonic welding.

The flexible bag or pouch may be of any size according to the use to which the container is to be put. For example where the container is to be used as a drinking bottle for young children or babies the volume of the bag or pouch when in its inflated form is at least 1 ml, preferably between 50 and 300 ml dependant upon the age. It is preferred, particularly with babies that the exact capacity of the bag is in relationship with the amount of the feed required. For other uses and situations the capacity may vary. The bag or pouch may be provided with an indicator for the volume of the contents. The bag or pouch may be made of any flexible material which should be chosen according to the use to which the container is to be put and the conditions to which it is to be subjected. It is preferred that the bag or pouch be made of a thermoplastic material such as a polymer film for example of polyolefines such as polyethylene or polypropylene or polyester such as polyethylene terephthalate or polybutylene terephthalate, polypropylene being preferred. The film may be laminar and may be provided with surface coatings if required for the use to which the container is to be put. It is preferable that the bag or pouch is transparent and that the contents can be seen, the bag and/or envelope may also be provided with writing or illustration according to the use to which the contents are to be put. It is also preferred that the bag or pouch can withstand temperatures up to 100° C. and may be provided with a temperature indicator.

The circumference of the bag or pouch at its open-end must be such that it can be fitted around the perimeter of the cover and can be held tightly to the perimeter of the cover by means of a band/clip and/or seal such as a weld. Where the bag or pouch is attached to the cover by welding it is preferred that the bag or pouch and the cover be made of similar materials and it is particularly preferred that both are made of polypropylene. A resin or adhesive may be used in some configurations of the present disclosure due to material selection but it is not preferred.

The cover may also be of any suitable material according to the use to which the container is to be put. The cover should however be sufficiently rigid to provide strength and integrity to the container when it contains the particular liquid for which it is designed. It is preferred that the cover be of a thermoplastic material and is preferably prepared by injection moulding. In particular we have found that polypropylene, ethylene/propylene copolymer rubbers or polyamides are particularly useful materials from which the cover can be made. Where the cover is made by injection moulding the non-return valve or seal may be integrally moulded with the cover.

In a preferred embodiment of the present disclosure where the container is used for baby feeding the container is provided with a teat. The teat is preferably of a flexible material such as synthetic rubber particularly a silicone rubber or a thermoplastic rubber such as the styrene isoprene block copolymers sold under the trade name Kraton. The teat is preferably collapsed within the cover of the container and may be released to its useable position by removal of a plug placed over the teat. The teat may be recollapsed within the cover by replacing the plug. In this way the remaining contents of the container may be secured if a feed does not use all the contents. It is also possible to recollapse the teat without touching it thus retaining a substantially sterile environment.

In a further embodiment the underside of the plug is provided with ribs and a cavity to facilitate the compression of the teat as the plug is engaged with the cover. As a further preferment a stop is provided to ensure that the plug is engaged with the cover to the desired extent and is prevented from over engagement which could result in damage to the teat.

In a further embodiment small protrusions are provided around the inner ring of the cover so that an audible click is produced as the cover is assembled to indicate that the components of the cover are fully engaged.

In a preferred embodiment the container of the present disclosure comprises a baby bottle comprising a bag or pouch hermetically sealed to the base of a cover system which comprises a bag holder to which the bag or pouch is secured and a cap which may be removably engaged with the holder the cap and the holder being such that the cap secures the base of a teat within the holder. The cover system also includes a plug which fits onto and/or within the cap to depress the teat within the cover system. In this way the teat may be collapsed or brought into use by introducing or releasing the plug. In a further embodiment the holder is provided with an opening device to allow the introduction of materials to within the bag or pouch. Our preferred opening device comprises a ring pull that may be integrally moulded with the holder.

In a further embodiment the container may be used with a bottle holder and/or warmer. This may also be flat packed and made of readily disposable material such as cardboard. The holder or warmer being such that the filled container may be mounted within the holder for security purposes and/or for warming the contents. One or more of such containers may be supplied together with a package of one or several flat packed containers of the invention.

Accordingly, prior to use, the container may be assembled, the bag or pouch evacuated and/or folded so that the container lies flat to provide a compact space saving, ready for use container. When the container is to be used as a drinking vessel particularly for young children and babies it may be sterilised prior to flat packing. In a further embodiment and as part of the vacuum packaging aspect of this invention the assembled container may be vacuum packed in for example a thermoplastic film such as a polyethylene or a polypropylene film in order to preserve the sterility of the container and optionally to provide protection against ultra violet rays using barrier protection laminar films.

The ready for use containers may therefore be supplied in a flat packed space saving mode and they may be pre-sterilised and with their sterility protected. The ready for use containers may be supplied in packages of several containers for example as a six or eight container package useful for picnics or holidays.

In use the container may be removed from the packaging and the desired contents introduced into the container either through the non-return valve or by removal of the seal. The container with its contents may then be transported during, for example, travel such as for picnics and the like. Once the contents have been consumed the container may be disposed of preferably for recycle.

The containers of the present disclosure therefore have the following benefits particularly when used as drinking containers for children and babies. Use of the pre-sterilised container replaces the current laborious sterilizing process and the associated apparatus that is required. The containers are small and compact and space saving. The filled containers can be subjected to microwave heating, warming by water, or they can be deep frozen, for storing expressed milk as one example. In a particular embodiment the container can be made of a material that will change colour when the contents reach a desired temperature. The tactile soft feeling of the flexible bag or pouch containing a drinkable liquid can provide enjoyment to the drinker, particularly a young child. Additionally, the valve holder can be shaped to allow the user to hold this part as well.

In a further embodiment of the invention ingredients such as powder, syrup, paste, cordial, dried food, liquid and/or granules particularly powdered milk or drink flavourings can be provided within the container prior to flat packing so that it may be necessary to add only water to obtain the desired drink.

The walls of the vessel should be flexible and inelastic. Flexibility means that the material at its thickness of use is able to completely recover its original shape and form from compression, concertina, flat pack, fanfold, stack, bend or twist. This comprehensive flexibility simultaneously maintains the integrity of the contents. Inelasticity ensures that the receptacle cannot be expanded beyond its desired volume.

Figure 10A:
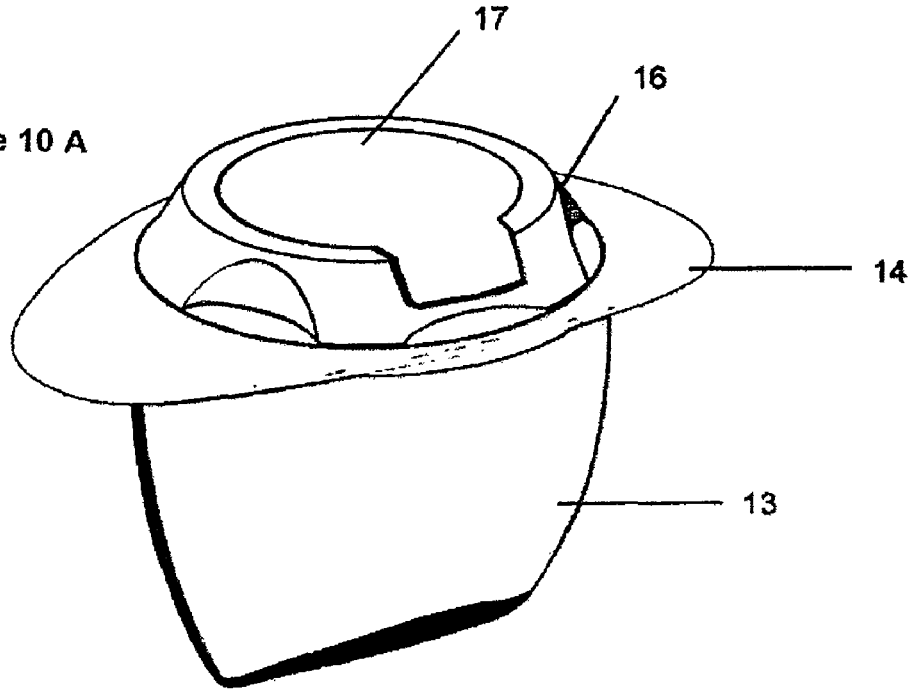
FIGS. 10A and B show the exterior of the containers of the schematic illustration of FIGS. 9A and B.
Figure 10B:
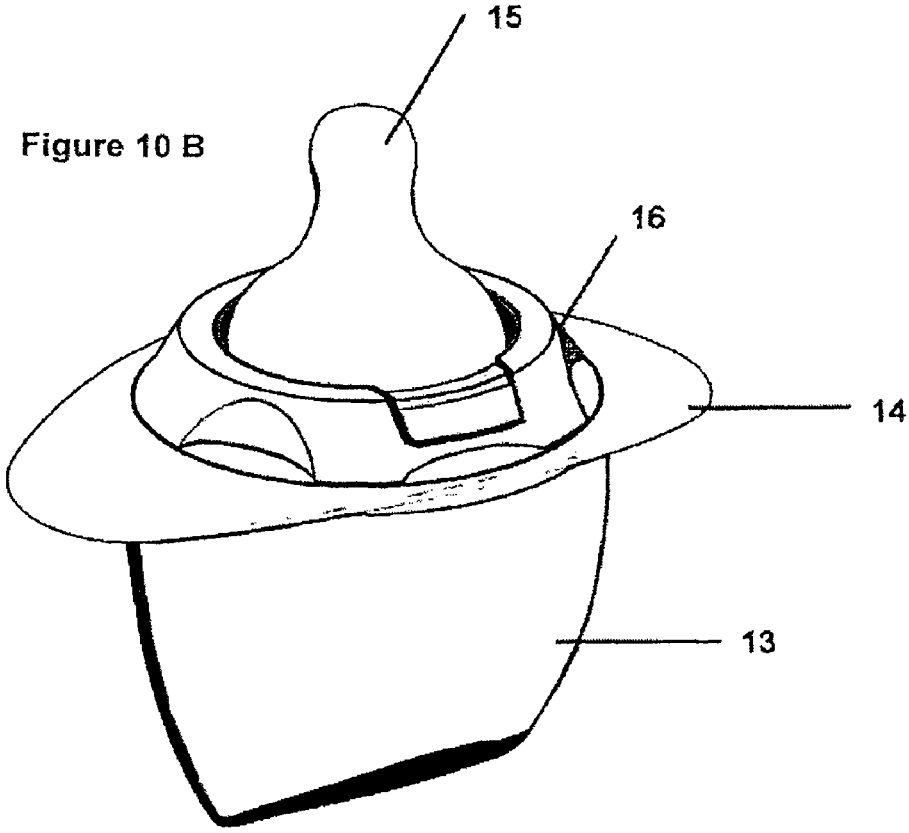

The container is conveniently made by mass production methods. Conveniently the receptacle is made in several pieces, the bag or pouch itself, the non-return valve or seal (opening device), the (non-return valve) holder, optionally a tamperproof clip and a fluid delivery tube, a cover and optionally a cap (that may contain a plug). The bag or pouch is preferably extruded and sealed at one end by a welding technique and is provided with an opening into which the (valve) holder and non return valve or seal can be. Alternatively, if pre-measured ingredients are to be put into the container prior to distribution such as milk powder or ready made formula, then the bag or pouch may be left open and not sealed until the container has been pre filled. The valve or seal holder may be injection moulded as can the valve or seal from materials such as medical grade or food grade polypropylene. A vacuum can be created within the receptacle, the receptacle is then sterilised and vacuum packed to avoid contamination prior to use. The valve or seal in one form can be made from any suitable material, it should be flexible and recover rapidly. Elastomers may be suitable or it may be made from synthetic rubber. Alternatively in another form the non-return valve may be made from the same or similar material as the non-return valve holder as can the seal illustrated in FIGS. 1Ci-iv. In a further embodiment the valve may be such that when it is attached, it may be rotated to provide an opening to the inside of the bag or a seal as shown in FIGS. 1Ai-ii. The seal (opening device) shown in FIGS. 1Ci-iv may come in the form of a thin film or similar material as the holder which can be removed or pierced. This is particularly useful if the container is pre-filled prior to use. In FIGS. 1Di-iii, seal (opening device) has been removed, as shown in FIGS. 1Ci-iv, to provide an opening to the inside of the bag. To replace the seal function of the variable cover sealing system, the fluid delivery tube, cap/lid and/or plug as shown in FIGS. 10A and 10B configuration can provide a seal to the contents of the bag or an opening that provides access thereto by rotation, replacement or removal therefore.

We prefer that the side walls or bag of the bag or pouch are either extruded and seamless or thin film, we also prefer that they have a thickness of from 25 μm to 150 μm, more preferably 40 μm to 110 μm most preferably of approximately 100 μm. These wall thicknesses ensure the collapsible, resurrectible and flexible nature of the bag or pouch. We have also found that at this thickness the walls are strong enough and are non-elastic on inflation.

The valve holder is preferably non-flexible and when assembling the container, the non return valve can be inserted into the valve holder which, in turn, is inserted into the extruded or thin film material pouch or bag allowing the non-elastic nature of the material to mould around the shape of the valve holder providing an air tight seal which may be secured by a band or clip, or a weld. Alternatively, the non-return valve can be attached creating a seal after this process. To prevent the receptacle being tampered with, to allow grip and splash prevention, to allow increased pressures into the receptacle and to hide the open end of the bag or pouch a tamperproof clip, which may be a circular band, may be applied surrounding the edge of the valve holder. The size of the tamperproof clip is preferably less than the diameter of the valve holder providing tension when in place. Alternatively, the tamperproof clip functions can be an integral part of the (valve) holder itself, see FIG. 3B.

We prefer the (valve) holder to be rigid because the tamperproof clip, when used, can apply pressure around the top of the receptacle when attached and it is desirable that the top does not flex under the tension. Additionally, the use of a rigid (valve) holder allows the shape of the side walls to retain its shape uniformally. We prefer cylindrical shape at certain points, but, oval and/or tapered are equally desirable. It also allows the receptacle when pulled from the base in its collapsed state to receive the fluid emission and maintain a consistent volume. The (valve) holder is preferably shaped so that a fluid delivery tube, such as a mouthpiece can be readily attached to the top of the bag or pouch. Typically, as one example, a teat such as a silicon or kraton teat for babies may be appropriate.

If a preferred container of the present disclosure is not already pre-filled with liquid, preparation of the drink can be achieved in the manner as illustrated in the flow diagram which is FIGS. 4Ai-v. Upon rotation of the lid which contains a collapsed mouth piece (which in this example is a teat), it may be removed from the holder. The seal may be removed, for instance, the ring pull (which in addition to the seal has been preventing the teat from engaging with the holder). The bag or pouch may then be filled to the desired or pre-measured level with chosen liquid which may include other pre-mixed contents. Typically, by way of example, for feeding a baby the bag would have a measured amount of milk powder inside with boiled water to be added as the liquid. After filling the lid with mouthpiece would be replaced into the holder, upon rotation of the lid the mouthpiece will be secured to the holder due to the flexible nature of the mouthpiece material moulding around the more rigid material shape of the holder. A seal will be created once the mouthpiece is in the correct position which can be indicated to the user by an audible click. Additionally, the lid creates a seal in this position. With the fluid delivery tube/lid mechanism still in the sealed position, the contents may then be shaken, stirred, mixed and/or simply left in desired conditions until consumption of contents is required, see FIGS. 4Bi-iii. When consumption is required the lid seal may be reversed by rotation and upon removal of the lid the mouthpiece resurrects itself to the shape ready for use. After use, a seal may be re-established by positioning the lid over the mouthpiece and rotating the lid whilst applying downward pressure. In a further preferment of the present disclosure, a replaceable plug situated within the cap/lid is used allowing the cap/lid to remain in its secured position and resurrecting the teat when removed as illustrated in FIGS. 10A and B. This enables the container(s) described to be used at a later date preventing contamination and/or release of contents. In this embodiment of the invention, there is no need to touch the mouthpiece by hand therefore preserving sterility. Additionally, the mouthpiece once secured into position forms a seal which strong enough to prevent leakage. If the container comes pre-filled with liquid, in this embodiment, removal of the ring pull is still required and the mouthpiece can be secured as described. If the contents of the container need to be warmed or cooled the shape of the valve holder can allow the filled bag or pouch to be immersed in water without the water touching the mouthpiece or lid as illustrated in FIGS. 4Bi-iii again preserving the sterility of the mouthpiece and contents. It is preferable when changing the temperature of the contents of the container to have one or more of the mouthpiece/cap/plug and/or ring pull combination sealing system of the container in the sealed position.

In another embodiment of the present disclosure, if the seal itself cannot create an opening to the inside of the container then the mouthpiece/fluid delivery tube needs to be able to reverse the seal function. This may be accomplished either by puncturing the seal in FIGS. 1Ci-iv, if the seal has not already been removed; or by creating an opening through protrusion by rotation or applying a downward pressure on the attached mouthpiece forcing the flexible non return valve back as shown in FIG. 1Bi-iii.

It is preferred that no resins or adhesives are used in the assembly or manufacture of the container ensuring that the integrity of the contents of the container is maintained. A vacuum can be created within the container, then sterilised and vacuum packed to avoid contamination prior to use.

The fluid containers may be used or purchased empty or they may be used or purchased with substances/fluids inside. Either way, use or purchase maybe individual, multiples of the same or combinations of different arrangements of fluid containers and/or attachments.

The fluid containers provide a flexible combination of flat-packed, sterile, inexpensive, versatile, pre-measured form of packaging that can be used in single or multiple systems or procedures that improves and maintains efficiency, quality and the integrity of the contents anywhere and at anytime. The receptacles when filled are also resistant to breakage upon impact.

Figure 5B:
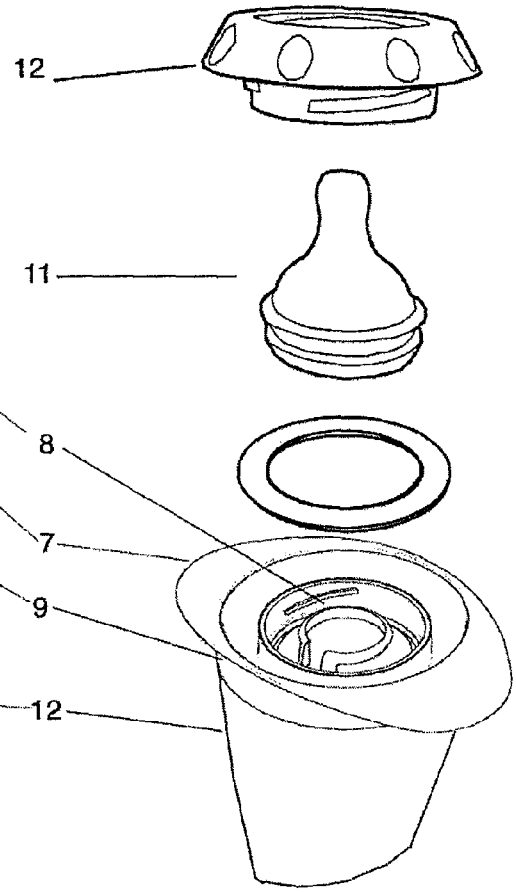

The present disclosure is illustrated by reference to the accompanying drawings in which FIGS. 1Ai-ii and 1Bi-iii show various types of non-return valves useful in one embodiment of the present disclosure, FIGS. 1Ci-iv shows a typical seal in the form of a ring pull which is useful in another embodiment of the present disclosure and FIGS. 1Di-iii shows a typical mouthpiece and lid configuration and interaction. FIGS. 2A and 2B show a flat packed packaged container according to the present disclosure and FIGS. 3A and 3B show the container of FIGS. 2A and 2B in inflated form containing a liquid (including mouthpiece and lid in FIGS. 2B and 3B). FIGS. 4Ai-v and 4Bi-iii show how the container in 2B and 3B can be used. FIGS. 4Bi-iii also illustrates how the shape of the holder can sit or hook onto water holders. FIGS. 5A and 5B are exploded views showing the components of the container and their method of assembly (including mouthpiece and lid in FIG. 5B).

FIG. 1A shows how a non-return valve (1) may be provided on the lid (2) that may be rotated to provide an opening (21). Similarly FIG. 1B shows how an opening may be provided by means of a valve (3) that can be rotated and depressed. FIG. 1C shows how a particular opening (21) may be provided when employing a ring pull (4).

FIG. 1Di shows how a mouthpiece (such as a teat) (5) can be contained with a cap and the opening can be provided and the mouthpiece delivered and secured to the top of the bag (6) by rotation of the cap and can be compressed within the cover by means of a cap lid or plug and converted to the position for use by removal of the cap lid or plug.

FIGS. 2A and 2B shows the holder (cover) of the container (7) with a non-return valve or seal (8), the bag or pouch is not visible in FIG. 2A since it is collapsed below the holder. However, FIG. 2A shows the circumferential band and/or weld (9) which attaches the bag or pouch to the holder (7) and in FIG. 2B the bag or pouch (23) is welded to the holder (7).

In FIG. 2A the container is showed protected by the impervious bag (10) which may also contain the fluid delivery tube (11) and in FIG. 2B the fluid delivery tube (11) is collapsed and temporarily secured within the cap (12).

FIGS. 3A and 3B shows the flexible bag or pouch (12) inflated and attached to the holder. The welded end of the pouch or bag may be of any shape but the illustration in FIG. 3A shows that a hole has been punched through the material to allow the container to be hung. Alternatively or in addition the flap can provide an extra place to grip.

FIGS. 4Ai-v and 4Bi-iii shows how the container of FIG. 2B can be removed from the impervious bag (10) and filled and warmed and can be laid to rest without touching or otherwise contaminating the mouthpiece.

FIGS. 5A and 5B are exploded versions of the containers of FIGS. 3A and 3B.

FIGS. 6A-C illustrates how the container maybe shaped for toddlers.

FIGS. 7A-C illustrates a flat packed resurrectable baby bottle stand which can be used for warming or cooling the container and its contents if a thin film bag material is attached to the stand as illustrated. In this design the sidewalls of the warmer/cooler are collapsible but once erected and filled the baby bottle/container can rest from the top of the warmer to heat/warm the contents. Alternatively, the flat packed resurrectable baby bottle stand can be used to rest the baby bottle/container upright.

Figure 8:
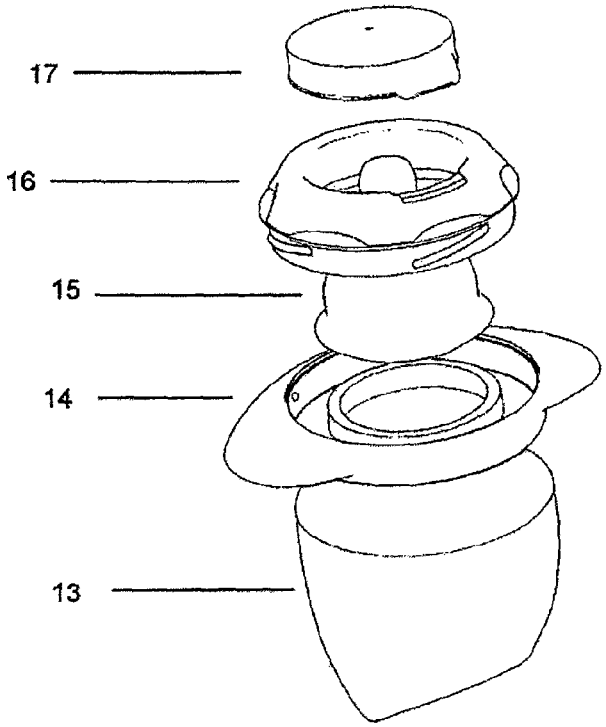
FIG. 8 shows an exploded view of a preferred container according to the present disclosure comprising a bag or pouch.

FIG. 8 shows an exploded view of a preferred container of the invention comprising a bag or pouch (13), a holder (14) to which the bag may be hermetically sealed a teat (15) which may be secured to the holder by engaging a cap (16) with the holder. Plug (17) can be applied on to the top of the cap to compress the teat (15) when it is not in use. Removal of the plug (17) then releases the teat for use. The holder (14) may be provided with a ring pull (not shown) to seal the bag or pouch prior to use and which can be removed to allow the desired contents to be introduced into the bag.

Figure 9A:
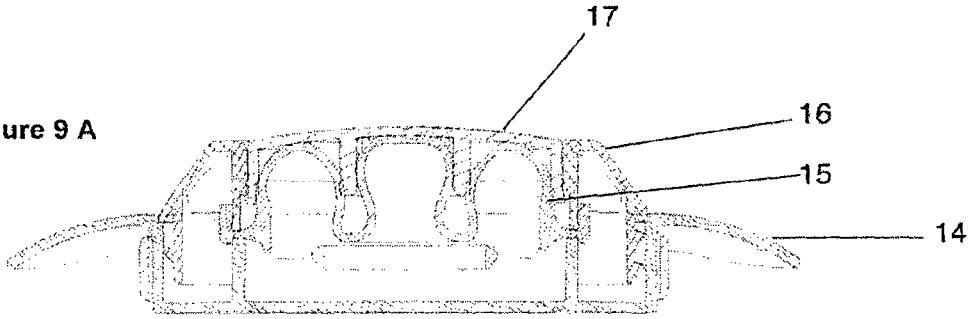
FIG. 9A is a schematic illustration showing how the teat may be collapsed.
Figure 9B:
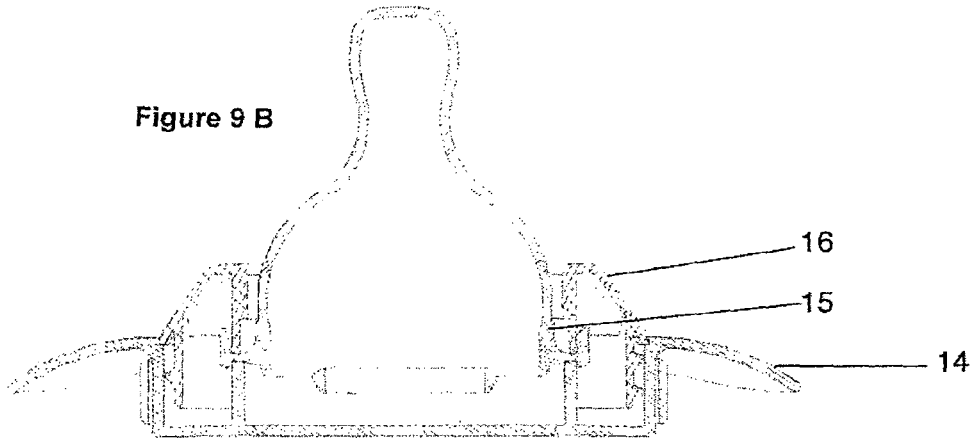
FIG. 9B shows how the teat may be placed ready for use by removal of a plug.

FIG. 9*a* is a schematic illustration showing how the teat (15) may be collapsed by placement of the plug (17) onto the cap (16) and FIG. 9*b* shows how the teat may be placed ready for use by removal of the plug.

FIGS. 10*a* and 10*b* show the exterior of the containers of the schematic illustration of FIGS. 9*a* and 9*b*.

The collapsible fluid container, as one example of many, can be used to ease the preparation and consumption of drinks such as coffee or tea for users who are traveling. The containers may be purchased over the counter or from vending machines and the flat packed fluid container can optionally hold mixtures of pre-measured types of coffees, milks and sugars which can have hot or boiling water added by pouring manually or injecting from a machine. With the non-return valve sealing the contents the container may be shaken or stirred to mix. Any form of fluid delivery tube may be used. The mouthpiece may provide permanent access to the contents (coffee) inside or with a simple twist or downward pressure the non-return valve can be reversed to release the contents. Due to the design of the non-return valve as illustrated in FIGS. 1Ai-ii, 1Bi-iii and 1Ci-iv the liquid will only be expelled upon demand. Spillage will not be an issue and due to the flexible nature of the side walls, the container can fit into many spaces by molding its shape to fit.

In instances that require extreme heat resistance such as boiling water, the tamperproof band's properties and/or valve holder shape can be used to prevent burning or injury to the user in a manner similar to that of an insulating sleeve used for paper cups.

Although the containers of the present disclosure have been described primarily in relation to bottles for babies and young children they may be used in a variety of other uses where space saving, single use and disposability are required. For example they may be used to provide liquids such as drinks in military operations, in travel such as in space travel or aircraft, in sporting activities and recreational activities such as walking and mountaineering. A further example of the collapsible fluid containers use is for the transport, storage and consumption of medicines to be taken orally and in veterinary applications where a pre-measured amount of material may be placed in the sterilized container which may then be flat packed and easily stored and transported prior to use. The container is also capable of storing oils, paints and the like. Using the correct fluid delivery tube such as a brush attachment or sponge, for example, the user can apply pressure by squeezing the flexible pouch or bag with the filled contents which can be applied to the desired surface. The volumetric flow can be controlled by the amount of pressure on the bag and the size of the opening created by the non-return valve, see FIGS. 1Ai-ii, 1Bi-iii and 1Ci-iv. Additionally, using the appropriate fluid delivery tube, liquid can fill the flat packed container and either be disposed of or taken away for sampling, for example urine samples for analysis.

The invention claimed is:

1. A flat packed container comprising flexible bag or pouch having an opening and having a maximum width dimension across said opening;

a cover system that covers said opening, comprising a holder to which the bag or pouch is attached that has a maximum dimension greater in magnitude that said maximum width dimension; whereby the maximum dimension of said holder permits said bag or pouch when filled to lie at an angle to a surface to prevent contamination of a mouthpiece;

a cap, wherein the holder is provided with an opening to enable the introduction of material into said bag or pouch; and a seal that seals the opening within the holder and which can be replaced to recreate the seal after filling.

2. A container according to claim 1, wherein said container is sterilised prior to flat packing.

3. A container according to claim 1, wherein said container is enclosed in hermetically sealed packaging.

4. A container according to claim 1, wherein said bag or pouch is formed of a material such that the contents are visible.

5. A container according to claim 1, wherein said bag or pouch is provided with pre-marked volume indicators.

6. A container according to claim 1, wherein said bag or pouch comprises side walls, and said side walls have a thickness of from 25 um to 150 um.

7. A flat packed container according to claim 6 in which said side walls of the bag or pouch are extruded and seamless.

8. A container according to claim 1, wherein said container can withstand temperatures up to 100° C.

9. A container according to claim 1, wherein said cover system is sufficiently rigid to provide strength and integrity to the container when it contains the particular liquid for which it was designed.

10. A container according to claim 9, wherein said cover system is made of polypropylene, ethylene/propylene copolymers rubbers or polyamides.

11. A container according to claim 1, further comprising a temperature indicator.

12. A container according to claim 1, wherein said container is a baby bottle.

13. The flat packed container according to claim 1, wherein said holder has a pair of opposed arms and a width across said pair of opposed arms is said maximum dimension.

14. A container comprising a bag or pouch having an open end hermetically sealed to a holder which provides an orifice for introducing material into the bag or pouch, said holder being adapted to releasably engage with a cap, said cap containing a delivery mechanism for the contents of the bag or pouch and said cap containing a sealing mechanism for the bag or pouch which may be exposed by removal of the cap to allow materials to be introduced into the bag or pouch wherein the cap may be replaced in the holder and thereby provide the delivery mechanism, wherein a maximum width dimension across a top of said holder is greater in magnitude than a maximum width dimension across an opening of the bag or pouch, when filled to lie at an angle to a surface to prevent contamination of the delivery mechanism.

15. A container according to claim 14, wherein the sealing mechanism and the delivery mechanism is a teat.

16. A container according to claim 14, further comprising a plug that is releasably engaged with the cap.

17. A container according to claim 16, wherein said plug compresses the teat to form the seal when applied and releases the teat for use when it is removed.

18. A container according to claim 17, wherein said teat when compressed provides the sealing mechanism.

19. A container according to claim 14, wherein said sealing mechanism comprises a ring pull.

20. A container according to claim 14, wherein said cap is engageable with the holder in a manner that secures the delivery mechanism in place.

21. A container according to claim 14, wherein said cap is engageable with the holder by means of a screw thread and stops are provided on the holder to control the extent to which the cap may be engaged with the holder.

22. A container according to claim 14, wherein said container is a baby bottle.

23. A flat packed container comprising a flexible bag or pouch having an opening and having a maximum width dimension across said opening;

a cover system that covers said opening, comprising a holder to which the bag or pouch is attached that has a maximum dimension greater in magnitude than said maximum width dimension;

a cap located within the holder, wherein the holder is provided with an opening to enable the introduction of material into said bag or pouch; and a seal that seals the opening within the holder and which can be replaced to recreate the seal.

24. A container according to claim 23, wherein said container is sterilised prior to flat packing.

25. A container according to claim 23 wherein said container is enclosed in hermetically sealed packaging.

26. A container according to claim 23 wherein said bag or pouch is formed of a material such that the contents are visible.

27. A container according to claim 23 wherein the bag or pouch comprises side walls, and said side walls have a thickness of from 25 μm to 150 μm.

28. A container according to claim 23 wherein said container can withstand temperatures up to 100° C.

29. A container according to claim 23 wherein said cover system is sufficiently rigid to provide strength and integrity to the container when it contains the particular liquid for which it was designed.

30. A container according to claim 23 wherein said cover system is made of polypropylene, ethylene/propylene copolymers rubbers or polyamides.

31. A container comprising a bag or pouch having an open end hermetically sealed to a holder which provides an orifice for introducing material into the bag or pouch, said holder being adapted to releasably engage with a cap located within the holder, said cap containing a delivery mechanism for the contents of the bag or pouch and said cap containing a sealing mechanism for the bag or pouch which may be exposed by removal of the cap to allow materials to be introduced into the bag or pouch wherein the cap may be replaced in the holder and thereby provide the delivery mechanism.

32. A container according to claim 31 wherein the sealing mechanism and the delivery mechanism is a teat.

33. A container according to claim 32 further comprising a plug that is releasably engaged with the cap.

34. A container according to claim 33 wherein said plug compresses the teat to form the seal when applied and releases the teat for use when it is removed.

35. A container according to claim 32 wherein said teat when compressed provides the sealing mechanism.

36. A container according to claim 31 wherein said container is a baby bottle.

* * * * *